United States Patent [19]

Gehring et al.

[11] Patent Number: 4,558,722

[45] Date of Patent: Dec. 17, 1985

[54] APPARATUS FOR THE CONSTRAINED ACTUATION OF THE CLAMPING SYSTEM OF FILLING YARN INSERTING MEMBERS IN SHUTTLELESS WEAVING MACHINES

[75] Inventors: Fritz Gehring, Lindau-Bodolz; Stephan Arndt, Sigmarszell; Harald Störr, Lindau, all of Fed. Rep. of Germany

[73] Assignee: Lindauer Dornier Gesellschaft mbH, Lindau, Fed. Rep. of Germany

[21] Appl. No.: 591,412

[22] Filed: Mar. 20, 1984

[30] Foreign Application Priority Data

Jun. 3, 1983 [DE] Fed. Rep. of Germany ..... 3320200

[51] Int. Cl.[4] ..... D03D 47/18

[52] U.S. Cl. ..... 139/446; 139/444; 139/445

[58] Field of Search ..... 139/443, 444, 445, 446, 139/438

[56] References Cited

U.S. PATENT DOCUMENTS

| | | | |
|---|---|---|---|
| 3,438,402 | 4/1969 | Kokkins | 139/446 |
| 3,665,975 | 5/1972 | Kokkins | 139/446 |
| 4,384,598 | 5/1983 | Häussler | 139/446 |

FOREIGN PATENT DOCUMENTS

| | | | |
|---|---|---|---|
| 1710292 | 4/1967 | Fed. Rep. of Germany | 139/446 |
| 1955603 | 11/1969 | Fed. Rep. of Germany | 139/446 |
| 2934474 | 10/1980 | Fed. Rep. of Germany | 139/446 |

*Primary Examiner*—Henry S. Jaudon
*Assistant Examiner*—Steven M. Shongut
*Attorney, Agent, or Firm*—W. G. Fasse; D. H. Kane, Jr.

[57] ABSTRACT

In a shuttleless weaving machine wherein the filling yarn is inserted from both sides of the shed by means of gripper systems provided with filling yarn clamping devices and advanced into and then retracted from the shed. The filling yarn is transferred from one gripper system to the other by a controlled opening and closing of the clamping devices. For this purpose, a guide rod mounted in a straight guide on the reed stay and displaceable toward the shed is provided, which is equipped at its end with a control finger. The control finger passes through the warp yarns of the shed and actuates the clamping device in the shed. The control motion is transmitted through a cam follower roller mounted on a rocker lever hinged to a coupling link which in turn is pivoted or hinged to the guide rod. The control finger is entirely pulled downwardly out of the shed for the reed beat-up. The masses which must be accelerated together with the reed are low and control finger vibrations are eliminated.

3 Claims, 4 Drawing Figures

APPARATUS FOR THE CONSTRAINED ACTUATION OF THE CLAMPING SYSTEM OF FILLING YARN INSERTING MEMBERS IN SHUTTLELESS WEAVING MACHINES

FIELD OF THE INVENTION

This invention relates to an apparatus in shuttleless weaving machines wherein the filling or weft yarn is inserted from both sides into the shed by means of gripper systems advanced into and then retracted from the shed. The gripper systems are equipped with clamping devices for the filling or weft yarn. Such an apparatus includes control levers for the positive actuation of the clamping devices. These control levers pass from the outside through the warp yarns of the shed and are pivotally supported on arms rigidly mounted on the batten or sley shaft. These control levers are actuated by cam follower means including a roller-equipped rocking lever articulated to a coupling link.

German Pat. No. 1,710,292 discloses a weaving machine with gripper rods advancing into and then retracting from the shed in an oscillating manner and entering this shed to approximately the same extent. Such a weaving machine includes an apparatus as described above. In this weaving machine, the filling yarn is seized by the clamping device of a gripper system outside the shed and is moved by the gripper into the approximate center of the shed. There, the filling yarn is transferred to the clamping device of a gripper system advanced from the opposite side and, upon the retraction of that gripper system, is pulled completely through the shed. The yarn transfer at the shed center takes place by a positive control of the participating clamping devices in such a manner that the control levers briefly pass from the outside through the warp yarns of the shed for opening and closing again the clamping devices. The actuation of the control levers is coupled to the main drive of the weaving machine and takes place not only at the filling or weft yarn transfer at the shed center but also can be applied when seizing and again releasing the filling or weft yarn outside the shed.

A separate control lever is provided in German Pat. No. 1,710,292 for each of the two gripper systems or for their clamping devices taking part in the yarn transfer at the shed center. A common cam coupled to the main drive of the weaving machine is associated with the two control levers for operating the motion of the control levers. The time sequence of opening and closing the clamping devices during the yarn transfer is implemented by an asymmetrical advance motion of the two gripper rods.

A further development of the apparatus is disclosed in German Pat. No. 1,955,603 wherein each control lever is actuated by its own cam. In this manner, the time sequence of the opening and closing motions of the clamping devices can be adjusted in such a manner that the yarn transfer at the shed center takes place when the two advanced gripper systems are at rest.

The control levers of both known apparatuses are pivotally supported on arms rigidly fixed to the batten or sley shaft. The control levers are actuated by a cam through a spring-loaded roller lever pivotally supported on the batten or sley shaft and cooperating with a coupling link. The axis of rotation of the roller lever or rocker arm for the actuation of the control levers therefore coincides with the axis of rotation of the batten or sley shaft. The above-mentioned arm not only drags the control lever along during the reed beat-up, but it also rotates the roller lever or rocker arm through a stop and drive member, whereby the cam follower roller is lifted off the cam. In this operation, the spacing between the stop and the drive member must be accurately set in order to achieve the proper control lever motion during the reed beat-up.

In this type of construction, the rollers no longer neatly rest against or detach from the cam running surface, but instead they tend to chatter at higher rotational speeds of the weaving machine. This means, therefore, that the rollers also will detach in undesired manner from the control cam, i.e., from the running surface thereof, when the rollers should be resting against the cam in accordance with the cam control curve. Since the control levers follow the roller motion through the coupling member or link, faulty actuation of the clamping devices in the gripper systems may take place. In that case a problem-free filling yarn transfer from one gripper system to the other is no longer assured. Furthermore, the roller chatter much stresses the cam running surfaces whereby these surfaces may be damaged.

In order to remedy these undesired features, German Pat. No. 2,934,474 provides for the rotatable support of the rocking lever sensing the cam motion, whereby the rocking lever is rotatably fixed to the machine outside the batten or sley shaft. In this arrangement the rollers do in fact remain in contact with the cam, the arm seated on the batten or sley shaft and the control lever with its support and the coupling link actuating the control lever must be moved during the reed beat-up and hence must be accelerated and declerated. The masses to be accelerated are significant and still cause undesired vibrations of the control lever which may impair the performance of the apparatus.

OBJECT OF THE INVENTION

Based on this state of the art, it is the object of the present invention to further reduce the masses of the apparatus which must be moved and to further avoid vibrations of the control lever.

SUMMARY OF THE INVENTION

According to the invention there is provided a control lever in the form of a rigid finger for influencing the clamping device of the gripper system, and the control lever or finger is secured to one end of a guide rod. The guide rod in turn is guided in a straight guide mounted to a reed stay. The straight guide permits movement of the control lever toward the shed in the weaving machine. The other end of the guide rod is articulated to a coupling link which in turn is articulated to a rocking lever driven by a cam drive.

Since the control finger is rigidly secured to the guide rod which projects only slightly from the straight guide mounted on the reed stay, and since only a simple, rectilinear displacement is performed, the reed beat-up does not cause any control finger vibrations. Moreover, the apparatus is substantially reduced in weight as compared to the prior art due to the elimination of various components. The arrangement may be such that the control finger is displaceably mounted on the guide rod for adjusting the elevational position of the control finger in which the control finger can be fixed, for instance by a tightening screw. Further, it is possible to mount the straight guide, including the guide rod and the control finger for displacement parallel to the direction of the filling yarn and along the reed stay. The end of the coupling link pivoted to the rocker arm is position-adjustable also.

BRIEF DESCRIPTION OF THE DRAWINGS

The invention will be further illustrated by way of example with reference to the accompanying drawings, in which.

DETAILED DESCRIPTION OF A PREFERRED EXAMPLE EMBODIMENT AND OF THE BEST MODE OF THE INVENTION

Figure 1:
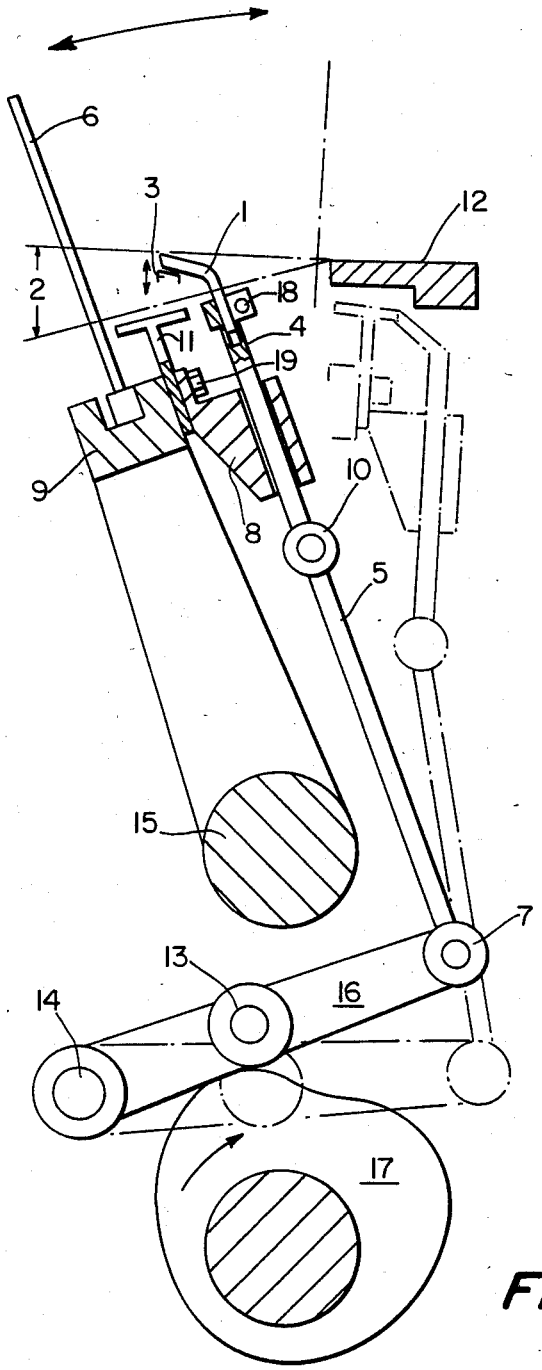
FIG. 1 is a schematic representation of the control finger and its operating mechanism at the reed whereby certain elements are shown in section.

FIG. 1 shows a reed stay 9 supporting a reed 6 on a batten. The reed 6 is non-rotatably mounted on the batten or sley shaft 15 through arms 22 and can be pivoted back and forth as shown by the arrows for the beat-up of the inserted filling yarn. The pivoting motion of the reed 6 extends across the shed 2 as far as the shed tip near the indicated expander rail 12. A batten sole 11 is also shown at the reed stay 9 for the purpose of supporting the filling yarn insertion members not shown. Only a clamping lever 3 for the clamping devices of the insertion members is indicated in the shed 2. The vertical double arrow in the shed indicates the opening and closing motion of the clamping lever 3 caused by the control lever or finger 1.

The control mechanism further includes, in a known manner, a constantly rotating drive cam 17 associated through a cam follower roller 13 with a rocker lever 16. The rocker lever 16 performs pivoting motions about its fixed pivot bearing 14 according to the control curve of the cam 17. The two end positions of the rocker lever 16 are shown on one hand by solid lines and on the other by dash-dotted lines. A coupling link 5 is connected by a first hinge or pivot 7 to the end of the rocker arm 16. The other end of the coupling link 5 is connected by a second hinge or pivot 10 to a guide rod 4. This guide rod 4 is guided in a straight guide 8 fixed to the reed stay 9. The straight guide 8 makes possible a precise guidance of the respective rod 4 and of the control finger 1 mounted on the guide rod in the direction toward the shed 2 and through the warp yarns of the shed 2. As mentioned above, the control finger 1 is rigidly mounted on the guide rod 4 but it also may be more or less displaced in height toward the warp yarns, for instance by a clamping means 18 and thus may be precisely adjusted in its position with respect to the clamping lever 3.

The operation of the apparatus will now be discussed below. With the reed 6 standing still, that is during the filling yarn insertion, the control cam 17 imparts a brief downward and then upward motion of small stroke to the control finger 1, whereby the clamping levers 3 of the filling yarn insertion members are opened and then again closed. Upon further rotation of the cam 17, while the reed 6 is still at rest, and after the filling yarn insertion members with their clamping devices 3 have been retracted, the guide rod 4 with the control finger 1 is pulled downwardly and out of the shed 2 as far approximately as the level of the batten sole 11. The reed beat-up can now take place unhampered in this retracted position, of the control finger 1, whereby the guide rod 4 together with the control finger 1 is pivoted into the position shown in dash-dotted lines. The batten sole 11 and the control finger 1 dip into an area underneath the expander rail 12 and an angle is formed at the hinge or pivot 10 between the guide rod 4 and the coupling link 5. Therefore, the beat-up of the reed 6 is in no way hampered. As the reed 6 after beat-up returns to the full line position shown in the drawing, the control finger 1 is also again ready for the insertion into the shed 2 and the control surface of the cam 17 again advances the control finger 1 into the full line position shown. A new filling yarn can be inserted and the clamping device 3 of the filling yarn insertion member again passes into the area tightly underneath the control finger 1.

Figure 2:
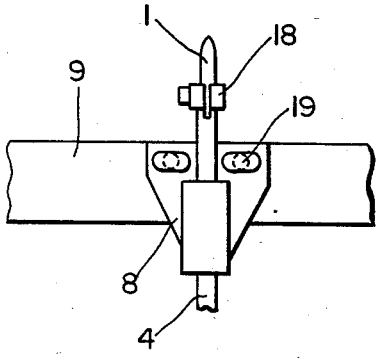
FIG. 2 is a partial side view of FIG. 1 from the right.

FIG. 2 is a partial side view of FIG. 1 showing a part of the reed stay 9 to which the straight guide 8 is secured, for instance by means of the screws 19. As shown by FIG. 2, the straight guide 8 can be displaced a certain length along the reed stay 9 due to the elongated holes through which the screws 19 extend for a precise adjustment to the position of the respective clamping device 3 of the advanced gripper member.

Figure 3:
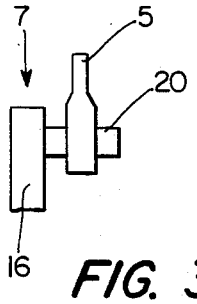
FIG. 3 is another partial side view of FIG. 1 from the right.

FIG. 3 shows a simplified side view of the hinge 7 providing the connection between the lower end of the coupling link 5 and the rocker lever 16. The drawing also indicates that the coupling link 5 can be moved along a pivot pin 20 so that in the event of a displacement of the straight guide 8, a corresponding adjustment can be performed at the other end of the coupling link 5.

The invention offers the advantages that the masses to be accelerated during the reed beat-up are reduced, and that the forces which during the actuation of the clamping devices press the gripper systems of the filling yarn insertion members against the reed and thereby generate wear at that location, are substantially reduced. The cam follower roller 13 is no longer lifted from the cam control surface during the reed beat-up.

It will be appreciated by those skilled in the art that many modifications may be made within the scope of the present invention without departing from the spirit thereof, and the invention includes all such modifications.

Figure 4:
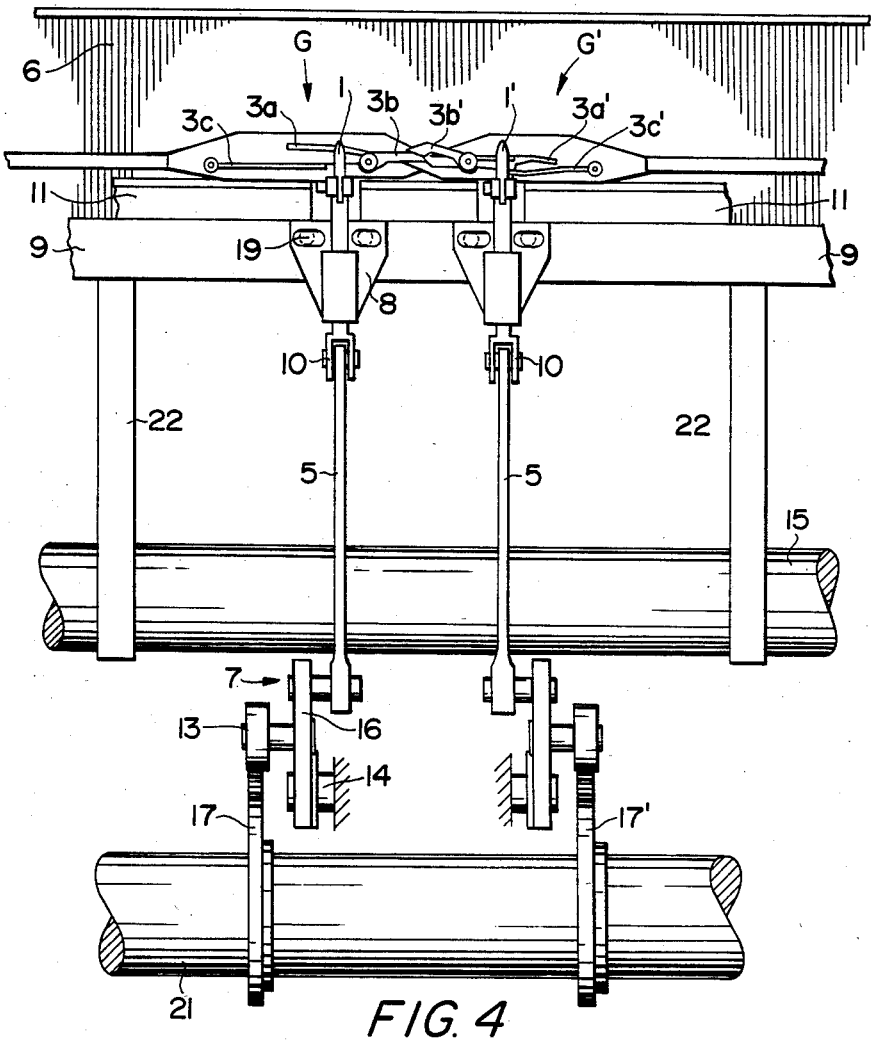
FIG. 4 shows a view in the direction from right to left in FIG. 1 for illustrating the grippers' cooperation with the components which control the opening and closing of the grippers.

Referring to FIG. 4, the drive cams 17, 17′ driven by their common drive shaft 21 in turn operate the grippers G and G′ through the elements described above with reference to FIGS. 1 to 3. Specifically, both grippers G and G′ are shown in the center of the shed for transferring a thread brought in by the gripper G to the gripper G′ which takes the thread out of the shed. Each gripper G, G′ has a clamping lever with two arms 3*a*, 3*b* and 3*a*′, 3*b*′ respectively as is conventional. Springs 3*c*, 3*c*′ are biasing the respective gripper arm into the closed position. The fingers 1, 1′ open and close the respective gripper arms 3*b* and 3*b*′. As shown, the gripper arms 3*a*, 3*b* are still closed for presenting the thread to the now open gripper arms 3*a*′, 3*b*′. This operation of the grippers is conventional. The invention resides in the guidance of the two gripper control fingers 1, 1′.

What we claim is:

1. In an apparatus for controlling the opening and closing of a thread gripper device in a shuttleless weaving machine including a reed stay mounted to a batten shaft, wherein a control member for said gripper device is driven by cam and cam follower means including a rocker lever carrying a cam follower, the improvement wherein said control member comprises a rigid control end for cooperation with the respective gripper device and a guide rod end for guiding said control member in its movement, straight guide means mounted to said reed stay, said guide rod end extending slidably through said straight guide means, a coupling link, first pivot means pivotally connecting one end of said coupling link to said rocker lever for transmitting a rocker movement to said coupling link, and second pivot means pivotally connecting said coupling link to said guide rod end for operating said rigid control end of said control member, whereby said second pivot means also permit a hinging motion between said coupling link and said guide rod end of said control member.

2. The apparatus of claim 1, wherein said rigid control end of said control member has a bent finger shape separate from said guide rod end, said apparatus further comprising means adjustably securing said finger shape to said guide rod end.

3. The apparatus of claim 1, further comprising means connecting said straight guide means to said reed stay for adjustment longitudinally along said reed stay, and wherein said first pivot means comprise an elongated pivot pin for permitting said adjustment longitudinally along said reed stay.

* * * * *